United States Patent [19]

Mitchell

[11] 4,451,184

[45] May 29, 1984

[54] APPARATUS AND METHOD FOR FEEDING PULVERIZED HYDROCARBONACEOUS SOLIDS INTO A HIGH PRESSURE REACTOR

[75] Inventor: David S. Mitchell, San Rafael, Calif.

[73] Assignee: Chevron Research Company, San Francisco, Calif.

[21] Appl. No.: 272,951

[22] Filed: Jun. 12, 1981

[51] Int. Cl.[3] ..... B65G 53/58

[52] U.S. Cl. ..... 406/105; 48/86 R; 48/DIG. 4; 201/31; 406/93; 406/144; 406/96

[58] Field of Search ..... 406/61, 84, 93, 105, 406/106, 144, 153, 96; 48/86 R, DIG. 4; 201/31

[56] References Cited

U.S. PATENT DOCUMENTS

| | | | |
|---|---|---|---|
| 2,919,159 | 12/1959 | Lacroix | 406/144 X |
| 3,512,841 | 5/1970 | Kollasch et al. | 406/153 X |
| 3,950,147 | 4/1976 | Funk et al. | 406/105 X |
| 4,157,245 | 6/1979 | Mitchell et al. | 48/DIG. 4 |
| 4,276,062 | 6/1981 | Lyon et al. | 48/DIG. 4 |

OTHER PUBLICATIONS

L. A. DeFrate and A. E. Hoerl, "Optimum Design of Ejectors Using Digital Computers", *CEP Symposium Series*, 21 (55), 43, 1959.

Bonin et al., "Development of Dry Coal Feeders", Proceedings of the Conference on Coal Feeding Systems, Jun. 21, 1977.

*Primary Examiner*—Jeffrey V. Nase

*Attorney, Agent, or Firm*—Burns, Doane, Swecker & Mathis

[57] ABSTRACT

The instant disclosure relates to the feeding of pulverized hydrocarbonaceous solids, such as coal, coke, tar sands, oil shale, etc., into a high pressure reactor for retorting or gasification of the solids. The pulverized hydrocarbonaceous solids are mixed with a motive fluid and pressurized in a jet ejector. The pulverized solid/-motive fluid mixture is then separated by a cyclone separator. The operation may be repeated in successive stages to achieve the desired pressures. The pressurized solids from the cyclone separator are introduced into the reactor, and motive fluid from the separator is recirculated to the jet ejector.

5 Claims, 4 Drawing Figures

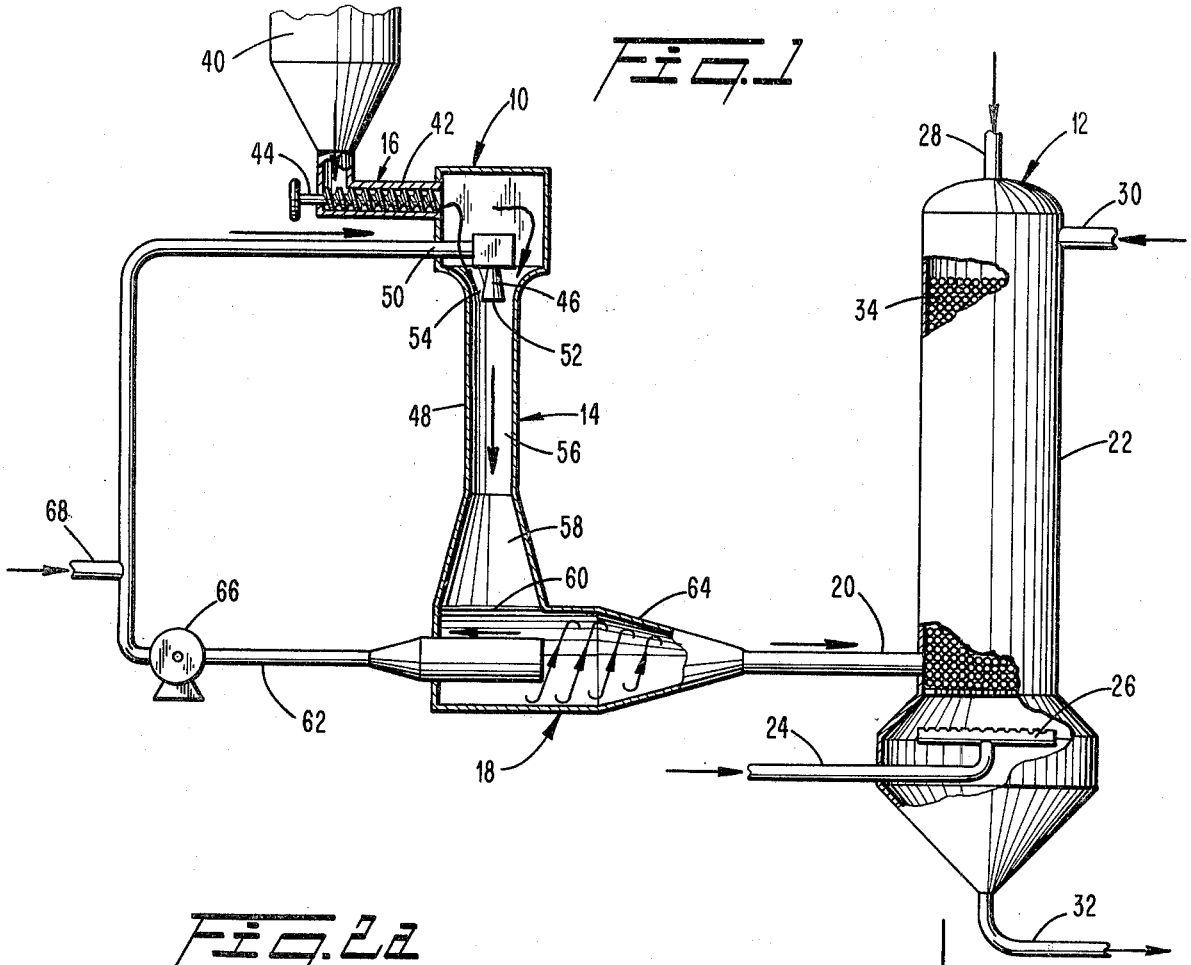
FIG. 1
FIG. 2a
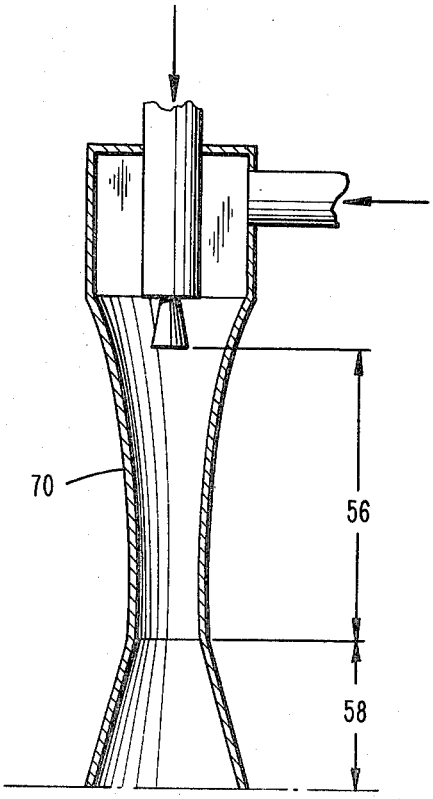
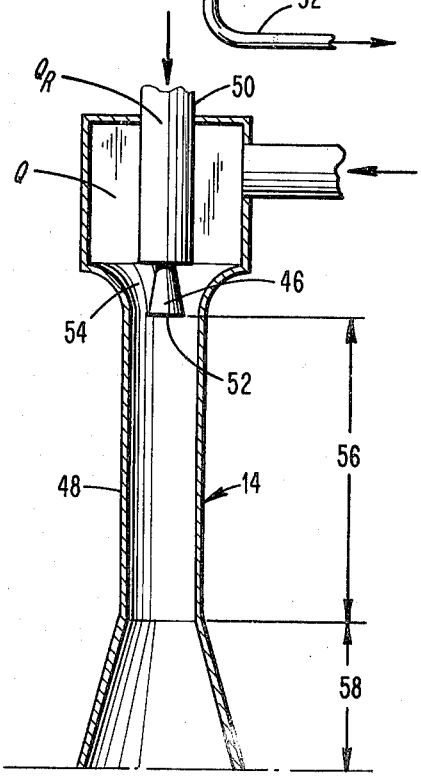
FIG. 2

APPARATUS AND METHOD FOR FEEDING PULVERIZED HYDROCARBONACEOUS SOLIDS INTO A HIGH PRESSURE REACTOR

BACKGROUND OF THE INVENTION

The instant disclosure relates to the feeding of hydrocarbonaceous solids into a high pressure reactor. More specifically, the instant disclosure relates to devices and processes for pressurizing pulverized hydrocarbonaceous materials such as coal, coke, tar sands, oil shale, etc., and supplying the pressurized material to a retorting and/or gasification system.

With the increase in oil and natural gas prices in the last decade, efforts have been mounted to provide alternative sources of energy. This country's reserves of coal, oil shale and tar sand contain enough hydrocarbonaceous material to supply this nation's energy needs for many years. A number of proposals have been made for processing these materials to convert their constituents into readily usable form such as liquid or gas. Some proposed processes call for heating or pyrolysis of these hydrocarbonaceous materials to boil off or liquify the hydrocarbons trapped in the solid. Other known processes involve the combustion of these hydrocarbonaceous materials with oxygen containing gases.

A number of processes under consideration involve the treatment of a quantity of pulverized hydrocarbonaceous materials with fluid in a pressurized retorting or gasification vessel. These systems may involve a fluid bed, entrained bed or moving bed of the pulverized hydrocarbonaceous material. Another system, which will be discussed specifically in connection with preferred embodiments of the present invention, is the countercurrent flow system for retorting and/or gasifying pulverized hydrocarbonaceous material, disclosed in U.S. Pat. No. 4,157,245 to Mitchell and Sageman.

Each of these systems requires that pulverized hydrocarbonaceous material be fed under pressure to the retorting or gasification vessel.

It is important to the success of such methods that the hydrocarbonaceous materials be pressurized; that the amount of energy expended in pressurizing the hydrocarbonaceous solids be minimized; that the hydrocarbonaceous solids be maintained in the desired comminuted form during pressurization and introduction into the retort or gasification vessel; that the flow of hydrocarbonaceous solids into the vessel not adversely effect bed dynamics or flow dynamics in the vessel; and that the flow of hydrocarbonaceous material into the vessel not introduce unwanted motive fluids into the vessel. Furthermore, it is advantageous that such feeding be performed continuously and at relatively high pressures (50–150 psi).

A number of proposals have been made for feeding hydrocarbonaceous material to high pressure reactors.

One proposal involves the use of a device known as a lock hopper. The lock hopper is a high pressure vessel into which pulverized solids are fed. The solids are pressurized by a gas pumped into the vessel. However, lock hoppers are large and mechanically cumbersome. A lock hopper may consume an unacceptable amount of vertical space in a processing apparatus. Lock hopper gas must be recompressed if significant energy losses are not to occur. Certain disadvantages of the lock hopper become more significant where heated material is to be pressurized. In such an application, lock hopper valves are more prone to failure, and the lock hopper must be insulated to prevent unacceptable heat loss.

Another proposal for feeding pulverized solids involves the use of a screw feeder, i.e., a rotating threaded member for advancing the pulverized solids through a conduit. See, e.g., "Smoothing the Flow of Materials Through the Plant: Feeders", F. Thomson, *Chemical Engineering,* Oct. 30, 1978. However, such mechanical feeding systems can only support a low pressure drop and for high pressures must be used in combination with lock hoppers.

A number of alternative devices for dry coal feeders are discussed in the article "Development of Dry Coal Feeders" by Bonin et al, Proceedings of the Conference on Coal Feeding Systems, June 21, 1977. The most pertinent of the feeders discussed by Bonin et al is a single stage gas or steam driven ejector. In tests reported by Bonin, a mixture of pressurized coal particles and motive gas from the ejector was introduced directly into a pressure vessel or receiver tank. However, if the coal/motive gas mixture is fed directly to a retorting or gasification vessel, the presence of the motive gas may disturb reactions, beds or flows in the vessel. Any loss of motive gas to the vessel prevents recirculation of that motive gas, with consequent loss of energy to the system. On the other hand, depending on the selection of motive fluid, it may be desirable to introduce a controlled fraction of the motive fluid with the hydrocarbonaceous solids into the high pressure reactor.

Accordingly, it is an object of the present invention to provide a technique for feeding pulverized hydrocarbonaceous solids into a high pressure reactor, which minimizes the amount of energy expended in pressurizing the material.

It is another object of the present invention to provide a technique for feeding heated, entrained hydrocarbonaceous particles into a high pressure reactor, which maintains the hydrocarbonaceous solids in comminuted form.

It is another object of the present invention to provide a technique for feeding pulverized hydrocarbonaceous solids into a high pressure reactor, which permits the introduction of the hydrocarbonaceous solids into the reactor vessel without substantially disturbing reactions, beds or flows in the vessel.

It is another object of the present invention to provide a technique for feeding pulverized hydrocarbonaceous solids into a high pressure reactor, which permits the continuous introduction of the hydrocarbonaceous solids into the reactor at relatively high pressures (50–150 psi).

It is yet another object of the present invention to provide a technique for feeding pulverized hydrocarbonaceous solids into a high pressure reactor, which permits introduction of a controlled fraction of a motive fluid into the reactor vessel with the pulverized solids entrained therein.

These and other objects and features of the invention will become apparent from the claims, and from the following description when read in conjunction with the accompanying drawings.

SUMMARY OF THE INVENTION

The present invention relates to devices and methods for feeding pulverized hydrocarbonaceous solids into a high pressure reactor. The pulverized hydrocarbonaceous solids may be a comminuted coal, tar sand, oil shale and the like. The high pressure reactor may be a vessel for retorting or gasifying the hydrocarbonaceous solids including devices of the moving bed, entrained bed, fluid bed, and countercurrent flow designs.

In a preferred embodiment of the present invention, pulverized coal is pressurized with steam for feeding the high pressure reactor. The feeding apparatus includes a jet ejector for providing a pressurized mixture of the motive fluid (steam) and the pulverized coal. A hopper or other transport device may be employed to supply the pulverized coal to the jet ejector. Energy for pressurizing the pulverized coal may be provided from a supply of pressurized motive fluid (steam) which is connected to the jet ejector.

A cyclone separator is located at the downstream end of the jet ejector for at least partially separating the coal from the pressurized motive coal/motive fluid mixture produced by the jet ejector. Subsequent to separation, the pressurized coal, which may still be entrained in a controlled fraction of the motive fluid, is introduced into the high pressure reactor. Alternatively, the output fluid of the separator may be introduced into a further pressurizing stage including another jet ejector and cyclone separator. Motive fluid (steam), separated from the coal/motive fluid mixture by the cyclone separator, may be recycled to the jet ejector by means of a recirculating pump. Since the separated motive fluid is at an elevated pressure, this recirculation lessens the amount of energy consumed in providing motive fluid to the jet ejector at high pressure.

In a preferred embodiment of the present invention the jet ejector may comprise a nozzle for the motive fluid and a venturi tube for mixing and pressurizing the coal/motive fluid mixture. An upstream opening of the nozzle may be connected to a source of pressurized motive fluid, such as a steam boiler compressor, or the like. A divergent, downstream exit passage of the nozzle introduces the motive fluid into the venturi tube. In this preferred embodiment, the venturi tube may include a convergent annular entry passage for the pulverized coal. Advantageously, the annular entry passage surrounds the motive fluid nozzle. A mixing passage, downstream from the annular entry passage, is provided to mix the coal and motive fluid. Finally, the coal/motive fluid mixture exits the venturi through a divergent diffuser passage downstream from the mixing passage. The diffuser passage of the venturi tube is connected to an entry port of the cyclone separator.

This disclosure also relates to a process for feeding pulverized hydrocarbonaceous solids into a high pressure reactor. The process is performed by passing the pulverized hydrocarbonaceous solids through an entry port of the venturi tube. A motive fluid nozzle is positioned in the entry port of the venturi tube. Pressurized motive fluid is supplied to the nozzle, and the pressurized motive fluid and the pulverized hydrocarbonaceous solids are mixed in a constricted portion of the venturi tube. A motive fluid/hydrocarbonaceous solids mixture, exiting the venturi tube, is centrifuged to at least partially separate the pressurized solids from the motive fluid. Subsequently, the separated, pressurized solids are introduced into a high pressure reactor. The motive fluid, separated from the mixture by centrifuging, may be returned to the motive fluid nozzle, preferably in combination with additional pressurized motive fluid.

BRIEF DESCRIPTION OF THE DRAWINGS

FIG. 1 is a diagrammatic illustration of a high pressure reactor system and system for feeding pulverized hydrocarbonaceous solids to the reactor in accordance with the present invention.

FIGS. 2 and 2*a* are diagrammatic illustrations of jet ejectors which may be employed in the feeding system of FIG. 1, showing details of the contruction thereof.

DETAILED DESCRIPTION

Figure 3:
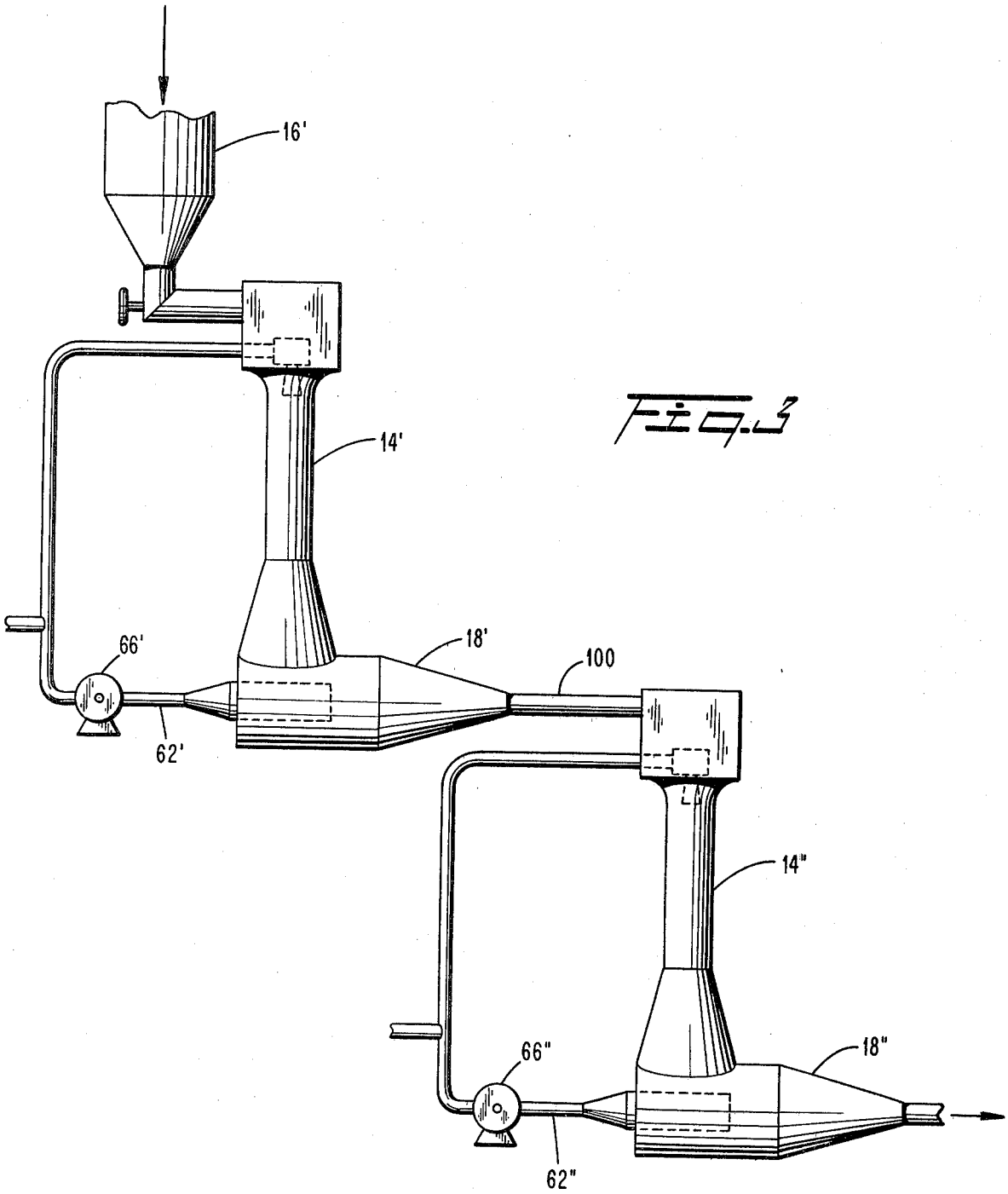
FIG. 3 is a diagrammatic illustration of a two stage system for feeding pulverized hydrocarbonaceous solids in accordance with the present invention.

The operation of and the preferred environment for the present invention will now be discussed with reference to the apparatus illustrated in FIG. 1.

The apparatus shown in FIG. 1 is an apparatus for handling and processing pulverized hydrocarbonaceous solids, and comprises a material handling section 10 and a high pressure reactor section 12. The particular high pressure reactor shown is of the type employed in the countercurrent flow reactor system disclosed in the above-mentioned patent to Mitchell and Sageman. It will be understood, however, that the material handling techniques which are the subject of this disclosure may be applied to feed material to many different types of high pressure processing systems, including moving bed systems, such as the well-known Lurgi process, entrained bed systems such as used in the well-known Koppers-Totzek process or the fluid bed systems of the well-known Union Carbide/Batelle coal gasification process.

The material handling section 10 may include three components: a jet ejector 14, a system 16 for storing and delivering hydrocarbonaceous solids to the jet ejector, and a cyclone separator 18, for separating pressurized hydrocarbonaceous solids from a motive fluid introduced in the jet ejector.

Pressurized hydrocarbonaceous solids from the cyclone separator 18 may be introduced into the high pressure reactor section at pressures from 50–150 psi via line 20. In a reactor vessel 22 of the reactor section 12, the pulverized hydrocarbonaceous solids may be entrained in a fluidizing gas supplied through line 24 to a manifold 26. The pulverized hydrocarbonaceous solids pass upwardly through the vessel where they react or are gasified and eventually exit the vessel via line 28. As discussed above, the particular reactor system shown is a countercurrent flow system, the countercurrent flow being provided by, for example, a fluidized, down-flowing solid heat transfer material such as hot sand, introduced into the reactor vessel 22 via line 30. Heat transfer occurs by means of rapid circulation in the reactor vessel 22 where heat is transferred to or from the heat transfer material. Subsequently, the heat transfer material may exit the vessel 22 via line 32.

For the operation of the reactor to be successful the flow of the two solid materials must be substantially countercurrent, and occur without substantial top to bottom mixing. Packing material 34 may be included in the reactor vessel for this purpose. It is also critical that the flow of pulverized hydrocarbonaceous materials from the cyclone separator not disturb the countercurrent flows desired in the reactor vessel 22.

With continued reference to FIG. 1, the operation of the material handling section of the illustrated apparatus will be described in greater detail. The system 16 for storing and delivering pulverized hydrocarbonaceous solids to the jet ejector may include a hopper 40 or similar storage vessel. The solid hydrocarbonaceous material itself may be maintained at atmospheric pressure in the hopper 40. In a preferred embodiment the solid hydrocarbonaceous material is coal crushed and sized by conventional means. Coal particles used are, preferably, less than 50 mesh. With the smaller mesh coal, a higher volume percent coal may be obtained in the coal/motive fluid mixture fed to the cyclone separator. Where the motive gas is steam, preferably, the pulverized coal constitutes approximately 10% by volume of a coal/steam mixture formed in the jet ejector.

In the embodiment shown in FIG. 1 the pulverized hydrocarbonaceous solids are gravity fed to the jet ejector via a line 42. Advantageously, the feeding of the coal from the hopper to the jet ejector may be facilitated by a mechanical feeding device such as screw feeder 44. Alternatively, the pulverized hydrocarbonaceous solids can be fed directly to the jet ejector by gravity or a fluidized transport system.

The jet ejector 14 may include a nozzle 46 and a venturi tube 48. The nozzle has an upstream opening 50 connected to a supply of pressurized motive fluid. Preferably, the motive gas is steam in systems such as coal gasifiers which employ steam. For such systems the motive steam should be superheated and above the dew point after expansion but below the temperature at which the coal particles tend to soften. Otherwise, the coal particles may tend to agglomerate to form composite particles not of the desired size for use in the reactor. Alternatively, flue gas may be used as the motive fluid. Nitrogen might also be used if the reactor is to be run on essentially pure oxygen with an oxygen generator/oxygen-nitrogen separator.

With continued reference to FIG. 1, the details of the construction of the motive fluid nozzle 46 and venturi tube 48 will now be described. The nozzle 46 is formed with a divergent downstream exit passage 52. The pulverized hydrocarbonaceous solids from the line 42 pass through a convergent annular entry passage 54 which surrounds the nozzle 46. This structure may be contrasted to that disclosed in the above-mentioned Bonin et al article wherein the pulverized hydrocarbonaceous solids are introduced into the jet ejector through a central passage surrounded by an annular motive fluid nozzle. The pulverized hydrocarbonaceous solids and motive fluid are mixed in a mixing passage 54, downstream from the annular entry passage 56. A divergent diffuser passage 58 is located downstream from the mixing passage 56 and receives the mixed hydrocarbonaceous solids and motive fluid.

The pulverized hydrocarbonaceous solids-motive fluid mixture may enter the cyclone separator through port 60 from the diffuser passage 58. Advantageously, the cyclone separator 18 may be a horizontal separator of the type shown in FIG. 1. The cyclone separator may be of a conventional type configured so that the incoming mixture flows tangentially into the cyclone separator and circulates through a plurality of turns in the manner indicated by the arrows in FIG. 1. A suitable alternative is a device sold under the Trademark MULTICLONE, which is a concurrent cyclone with vanes to impart the swirl or cyclone effect. In the cyclone separator 18, centrifugal force tends to separate the heavier hydrocarbonaceous solid particles from the motive fluid so that the hydrocarbonaceous solids collect at the circumference of the cyclone separator. Accordingly, the motive fluid tends to move toward the axis of the cyclone and may be withdrawn through line 62, while the hydrocarbonaceous solids may be collected in the funnel portion 64 of the cyclone separator for subsequent introduction into the reactor vessel 22. It will be apparent to one skilled in the art that the appropriate selection of cyclone design and operating parameters may be used to control the amount of motive fluid removed from the mixture, to thereby control the amount of motive fluid which will enter the reactor vessel with the solids entrained therein.

In one embodiment, the at least partially separated, pressurized material can be passed to a subsequent stage pressurizer constructed in a fashion analogous to the jet ejector and cyclone separator combination described above. Such a multistage system may be particularly useful in hydroretorting of shale. In another embodiment, the at least partially separated, pressurized material can be introduced into an intermediate chamber, such as a surge or feed bin, from which the pressurized material may then be injected into the reactor vessel by gravity, a screw feeder, or a like mechanical expedient.

Motive fluid withdrawn from the cyclone separator via line 62 may be recirculated to the jet ejector nozzle. Advantageously this may be accomplished by means of a recirculation pump 66. As needed, additional motive fluid may be introduced into the system via motive fluid supply line 68.

It should be noted that complete separation of motive fluid and hydrocarbonaceous solids need not be achieved in the cyclone separator. However, the system permits at least some amount of separation and recycling of the motive fluid which facilitates control and optimization of the amount of motive fluid introduced into the reactor vessel. This control permits the feeding of the hydrocarbonaceous solids under pressure without disruption of the reaction, beds or flows in the reactor vessel. For example, in gasification of coal using steam in the reactor vessel, pulverized coal may be fed to the reactor using steam as the motive fluid. However, all of the steam needed to pressurize the pulverized coal may not be needed or wanted in the reactor. The above-described system permits an unwanted fraction of the motive steam to be recycled.

With reference to FIG. 2 some design and operating parameters of the feeding system of the present invention are described in greater detail. In FIG. 2 the mixing passage 56 and the diffuser passage 58 of the jet ejector are shown. An alternative section contour 70 for the shape of the venturi tube 48 is shown in FIG. 2*a*.

Design equations for a jet ejectors are given in the article "Optimum Design of Ejectors Using Digital Computers", L. A. DeFrate and A. E. Hoerl, *CEP Symposium Series,* 21 (55), 43, 1959.

Parameters relating to the operation of the jet ejector are indicated by letter symbols in FIG. 2. The symbol "Q" indicates the volumetric flow rate of the hydrocarbonaceous material in the jet ejector, while the symbol "$Q_r$" indicates the volumetric flow of the motive fluid. Advantageously, the ratio of $Q_r$ to Q is one or greater.

FIG. 3 is a diagrammatic illustration of a two stage system for feeding pulverized hydrocarbonaceous solids in accordance with the present invention. The first stage of the system may include an apparatus for storing and delivering pulverized solids 16', a jet ejector 14' for receiving and pressurizing the solids, and a cyclone separated 18' for at least partially separating the motive fluid for the solids.

Material exiting the cyclone separator 18' is fed via conduit 100 to the second stage of the system. It will be readily understood that a system with more than two stages may be built by adding stages to the system in a like manner. The second stage may include a second jet ejector 14" and a second cyclone separator 18". The component parts of each of the stages of the system may be constructed in accordance with the teaching presented in connection with FIGS. 1 and 2 above.

It may be noted that each stage of the system of FIG. 3 has a self-contained recirculation system, i.e. motive fluid separated in the first stage is recirculated to the first jet ejector 14' via line 62' and recirculation pump 66'; likewise, motive fluid separated in the second stage is recirculated to the second jet ejector 14" via line 62" and recirculation pump 66". This arrangement reduces the amount of energy expended in providing the motive fluid used at each of the stages.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. An apparatus for primary feeding of entrained particulate materials into a high pressure section of a fluidized bed reactor, comprising:

a first pressurization stage including:

a first venturi tube;

means for supplying the particulate material through an entry port of the first venturi tube;

a first motive gas nozzle in the entry port of the first venturi tube;

means for supplying pressurized motive gas to the first nozzle, the motive gas being mixed with the particulate material in the first venturi tube to form a first pressurized particulate material/motive gas mixture; and a first centrifugal means for separating a predetermined amount of the motive gas from the particulate material/motive gas mixture; and a second pressurization stage, for receiving and further pressurizing the separated particulate material/motive gas mixture from the first centrifugal means, including:

a second venturi tube;

means for supplying the particulate material/motive gas mixture through an entry port of the second venturi tube;

a second motive gas nozzle in the entry port of the second venturi tube;

means for supplying pressurized motive gas to the second nozzle, the motive gas being mixed with the particulate material in the second venturi tube to form a second pressurized particulate material/motive gas mixture; and second centrifugal means for separating a predetermined amount of the motive gas from the second particulate material/motive gas mixture to be introduced into the high pressure section of the reactor; and means for recirculating the motive gas from the first and second centrifugal means to the first and second motive gas nozzles;

whereby the pressure of the particulate material introduced into the reactor is raised 50–150 psi by the feeding apparatus to a pressure greater than the pressure within the high pressure reactor.

2. The apparatus of claim 1 wherein the particulate material is pulverized coal 50 mesh or less in size; wherein the motive gas is steam and wherein the pulverized coal constitutes approximately 10% by volume of a coal/steam mixture formed in the venturi.

3. The apparatus of claim 2 wherein the ratio of the volumetric flow rate of the steam, $Q_R$, to the volumetric flow rate of the pulverized coal, Q, is one or greater.

4. A process for feeding pulverized hydrocarbonaceous solids into a high pressure reactor comprising the steps of:

(a) passing the pulverized hydrocarbonaceous solids through an entry port of a venturi tube having a motive fluid nozzle therein;

(b) supplying pressurized motive fluid to the nozzle;

(c) mixing the pressurized motive fluid and the pulverized hydrocarbonaceous solids in a constricted portion of the venturi tube;

(d) centrifuging the pressurized motive fluid/pulverized solids mixture to at least partially separate the pressurized solids;

(e) recirculating motive fluid separated from the pressurized motive fluid/pulverized solid mixture to the motive fluid nozzle;

(f) repeating steps (a) through (e) on the separated, pressurized solids to increase the pressurization thereof; and (g) introducing the separated, pressurized solids into the high pressure reactor at a pressure greater than 50 psi.

5. An apparatus having at least two pressurization stages for feeding entrained particulate material into a high pressure reactor, said apparatus comprising:

a first pressurization stage itself comprising:

a first venturi tube;

means for supplying the particulate material through an entry port of the first venturi tube;

a first motive gas nozzle in the entry port of the venturi tube, through which a pressurized motive gas passes, which motive gas is mixed with the particulate material in the first venturi tube to form a pressurized particulate material/motive gas mixture;

first centrifugal means for separating a predetermined amount of the motive gas from the particulate material/motive gas mixture; and first means for recirculating the motive fluid separated by the first centrifugal means to the first motive gas nozzle; and a second pressurizing stage, comprising:

a second venturi tube to which the output mixture from the first centrifugal means is supplied;

a second motive gas nozzle in the entry port of the venturi tube, through which a pressurized motive gas passes, which motive gas is mixed in the second venturi tube with the output mixture of the first centrifugal means;

second centrifugal means for separating a predetermined amount of the motive gas from the particulate material/motive gas mixture produced in the second venturi; and second means for recirculating the motive fluid separated by the second centrifugal means to the second motive gas nozzle.

* * * * *